US011248334B2

(12) United States Patent
Vitali et al.

(10) Patent No.: US 11,248,334 B2
(45) Date of Patent: Feb. 15, 2022

(54) LAUNDRY APPLIANCE WITH CAPACITIVE LAUNDRY DRYING DEGREE SENSING FUNCTION

(71) Applicant: Electrolux Appliances Aktiebolag, Stockholm (SE)

(72) Inventors: Fabio Vitali, Porcia (IT); Vincenzo Romeo, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 93 days.

(21) Appl. No.: 16/860,488

(22) Filed: Apr. 28, 2020

(65) Prior Publication Data

US 2020/0256006 A1 Aug. 13, 2020

Related U.S. Application Data

(63) Continuation of application No. 15/770,670, filed as application No. PCT/EP2016/075190 on Oct. 20, 2016, now Pat. No. 10,676,859.

(30) Foreign Application Priority Data

Oct. 26, 2015 (EP) ..... 15191441

(51) Int. Cl.
*F26B 3/00* (2006.01)
*D06F 58/38* (2020.01)
(Continued)

(52) U.S. Cl.
CPC ..... *D06F 58/38* (2020.02); *D06F 25/00* (2013.01); *D06F 34/18* (2020.02);
(Continued)

(58) Field of Classification Search
CPC .. D06F 58/38; D06F 2103/04; D06F 2103/24; D06F 2103/38; D06F 2103/54;
(Continued)

(56) References Cited

U.S. PATENT DOCUMENTS 4,215,486 A 8/1980 Heyer et al.
4,438,402 A 3/1984 Cullen et al.
(Continued)

FOREIGN PATENT DOCUMENTS

DE 19651883 C1 4/1998
DE 102009029621 A1 3/2011
(Continued)

OTHER PUBLICATIONS

USPTO Notice of Allowance issued in U.S. Appl. No. 16/472,506, dated Jun. 18, 2021, 8 pages.
(Continued)

*Primary Examiner* — John P McCormack
(74) *Attorney, Agent, or Firm* — RatnerPrestia

(57) ABSTRACT

A method for measuring the humidity of a laundry mass contained in a laundry treatment chamber of a laundry appliance. The method includes: providing a capacitor in the laundry appliance, the capacitor having, as part of the capacitor dielectric, the laundry mass; measuring a capacitance of the capacitor by means of an electronic circuitry electrically supplied by a supply voltage and a reference voltage. Providing a capacitor comprises: providing in the laundry appliance at least one conductive plate which forms a plate of the capacitor, and exploiting, as a second plate of the capacitor, routing lines distributing inside the laundry drying appliance the reference voltage.

11 Claims, 5 Drawing Sheets

(51) Int. Cl.

| | |
|---|---|
| *D06F 25/00* | (2006.01) |
| *D06F 103/08* | (2020.01) |
| *D06F 103/10* | (2020.01) |
| *D06F 103/04* | (2020.01) |
| *D06F 103/24* | (2020.01) |
| *D06F 103/38* | (2020.01) |
| *D06F 103/54* | (2020.01) |
| *D06F 34/18* | (2020.01) |

(52) U.S. Cl.
CPC ..... *D06F 2103/04* (2020.02); *D06F 2103/08* (2020.02); *D06F 2103/10* (2020.02); *D06F 2103/24* (2020.02); *D06F 2103/38* (2020.02); *D06F 2103/54* (2020.02)

(58) Field of Classification Search
CPC .. D06F 2103/08; D06F 2103/01; D06F 34/18; D06F 25/00
USPC ..... 34/491, 108
See application file for complete search history.

(56) References Cited

U.S. PATENT DOCUMENTS

| | | | | |
|---|---|---|---|---|
| 4,482,581 | A | 11/1984 | Lorin et al. | |
| 4,965,698 | A | 10/1990 | Thoma et al. | |
| 5,757,181 | A | 5/1998 | Wolf et al. | |
| 6,079,121 | A * | 6/2000 | Khadkikar | G05D 22/02 34/528 |
| 6,784,673 | B2 | 8/2004 | Tomasi et al. | |
| 2003/0235993 | A1 | 12/2003 | Leung et al. | |
| 2004/0051540 | A1 | 3/2004 | Tomasi et al. | |
| 2004/0211083 | A1 | 10/2004 | Park | |
| 2013/0119055 | A1* | 5/2013 | Wohl | H05B 6/62 219/774 |
| 2014/0020262 | A1* | 1/2014 | Altinier | D06F 58/38 34/499 |
| 2014/0152519 | A1 | 6/2014 | Buyuk-Kalender et al. | |
| 2014/0325865 | A1 | 11/2014 | Wisherd et al. | |
| 2015/0101207 | A1 | 4/2015 | Herman et al. | |
| 2015/0124416 | A1 | 5/2015 | Lin | |
| 2015/0153104 | A1 | 6/2015 | Bae et al. | |
| 2015/0185176 | A1 | 7/2015 | Koo et al. | |
| 2016/0130743 | A1 | 5/2016 | Wisherd et al. | |

FOREIGN PATENT DOCUMENTS

| | | | | |
|---|---|---|---|---|
| EP | 0967319 | A1 | 12/1999 | |
| EP | 1413664 | A1 | 4/2004 | |
| EP | 2458075 | A1 | 5/2012 | |
| EP | 2601339 | A2 | 6/2013 | |
| EP | 3124676 | A1 | 2/2017 | |
| EP | 3162952 | A1 | 5/2017 | |
| WO | 2006040781 | A2 | 4/2006 | |
| WO | 2012016820 | A2 | 2/2012 | |
| WO | WO-2016091717 | A1 * | 6/2016 | G06K 19/07749 |

OTHER PUBLICATIONS

International Search Report and Written Opinion for International Application No. PCT/EP2018/055681, dated Nov. 22, 2018, 12 pages.
International Search Report and Written Opinion for International Application No. PCT/EP2016/082747, dated Sep. 12, 2017, 11 Pages.
USPTO Non Final Office Action issued in U.S. Appl. No. 16/472,506, dated Feb. 23, 2021, 24 pages.
International Search Report and Written Opinion for International Application No. PCT/EP2016/075190, dated Jan. 2, 2017, 8 pages.
Entire patent prosecution history of U.S. Appl. No. 15/770,670, filed, Apr. 24, 2018, entitled, "Laundry Appliance With Capacitive Laundry Drying Degree Sensing Function."

* cited by examiner

LAUNDRY APPLIANCE WITH CAPACITIVE LAUNDRY DRYING DEGREE SENSING FUNCTION

This application is a continuation of U.S. application Ser. No. 15/770,670, filed on Apr. 24, 2018, which claims priority to International Application No. PCT/EP2016/075190, filed on Oct. 20, 2016, which claims priority to European Application EP 15191441.3, filed on Oct. 26, 2015, all of which are incorporated herein by reference.

BACKGROUND

Field of the Present Invention

The present invention generally relates to the field of laundry (linen, clothes, garments and the like) treatment appliances (hereinafter, shortly, laundry appliances), and particularly to appliances for drying laundry or laundry drying appliances (laundry dryers or laundry washing machines also implementing a laundry drying function, also referred to as combined laundry washers and dryers). Specifically, the present invention relates to a laundry appliance with capacitive laundry mass drying degree sensing function, for controlling the progress of the laundry mass drying process.

Overview of the Related Art

Laundry drying appliances exploit a flow of warm air for drying a laundry mass.

The laundry mass to be dried is housed in a laundry drying chamber, which quite often comprises a rotary drum accommodated within a machine cabinet and rotatable for causing the laundry to tumble while drying air is forced to pass therethrough (such appliances are also called "tumble dryers"). The rotation of the drum causes agitation of the items in the laundry treatment chamber that are to be dried, while the items being dried are hit by the drying air flow.

Combined laundry washer and dryer appliances combine the features of a washing machine with those of a dryer. In combined laundry washer and dryer appliances, the rotary drum is contained in a washing tub.

In laundry drying appliances that are not equipped with a laundry mass humidity measuring system, the user has to set a laundry drying program by choosing the time duration thereof. To do so, the user can rely on recommendations, e.g. in the form of time charts, provided by the appliance manufacturers, but this may lead to excessive and useless power consumptions if the laundry drying programs set by the user have drying times longer than what is actually required for drying the specific load of laundry. For example, some users may intentionally or unintentionally disregard the recommendations of the appliance manufacturer and set laundry drying programs that last more than what suggested by the appliance manufacturer for specific types of laundry. Moreover, even following the recommendations of the appliance manufacturer, the set drying programs may not achieve optimal results in terms of drying performance and power consumption.

In some laundry drying appliances the drying process duration is predetermined according to the user selected drying program. Also in this case the results of the drying process strongly depend on the laundry amount (laundry mass) placed within the drying chamber and the laundry type.

Laundry appliances are known which are equipped with laundry mass humidity measuring systems.

Present systems for measuring the laundry mass humidity are mostly based on a laundry mass electrical conductivity measurement, that is on laundry mass resistivity, which varies as a function of the laundry mass humidity degree. Such a solution is for example described in DE 19651883 and in EP 2601339.

EP 1413664 discloses a method and system for measuring the linen humidity in washing machines, dryers and the like. The method comprises arranging the two plates of a condenser around the linen, so that the latter acts as a dielectric; measuring the capacity of this condenser; determining the humidity of the linen according to the measured capacity. In particular, a metal plate is fixed with a biadhesive tape to the outer surface of the inner wall of the door for introducing linen in the laundry treating chamber. The metal plate has a substantially semicircular shape and is arranged in the lower half of the door inner wall. The door outer wall prevents from a possible direct contact of the user with the metal plate, thus avoiding the measure to be altered by eddy conductivities introduced by this contact. The laundry treating chamber and the metallic plate, which are electrically insulated one from the other, act as the plates of a condenser having as dielectric the inner wall of the door, the linen and the air contained in the laundry treating chamber. The laundry treating chamber is earthed in a known way, while the metal plate is connected to an electric and/or electronic control device, which measures the capacity C of the condenser and supplies a control signal to the drying system of the machine according to the measured capacity C. The permittivity of linen varies considerably according to the humidity thereof, while the permittivities of the door inner wall and of air are substantially constant or vary insignificantly.

SUMMARY

The Applicant has observed that laundry mass humidity measuring methods based on the measurement of the laundry mass impedance (that it is possible to read by contacting the laundry mass) are not precise. Thus, a control of the progress of the laundry drying process based on the measurement of the laundry mass impedance provides scarce results, especially in terms of precision in determining the actual laundry mass humidity.

In particular, trying to measure the laundry mass humidity by measuring the laundry mass resistitivity, being directly carried out on the laundry mass, requires to accomplish an electrical connection (electrical contact) with the laundry mass. The electrical contact with the laundry mass should be constant in time also when the position of the laundry mass inside the drum varies in consequence of the repeated tumbling, and this is something rather difficult to attain. Such an electrical connection is generally carried out by means of wiping contacts, which however have a poor reliability during the time, or by means of electrical terminals arranged in the inner side of the laundry appliance frame defining an opening which gives access to the laundry drying chamber, which however do not always ensure an electric continuity. Both of these two solutions (wiping contacts and electrical terminals) are complex from a manufacturing point of view and are rather inaccurate in determining the actual laundry mass humidity, especially in the last part of a drying process, when laundry is almost completely dried.

Accuracy of the two technical solutions described above depends also by the arrangements adopted in the appliance, especially the drum and its driving arrangements, to bring wet laundry in contact with the electrical terminals of the laundry mass humidity measuring system during the whole drying process.

In particular, the measure of the laundry mass impedance by contact is influenced by possible contact/non-contact and by the pressure of the contact. Especially when the laundry is almost dry, the impedance of laundry impedance is very high and the measure can be influenced by the electrostatic charge that is due to the rub of the linen against electrically insulated machine parts.

Moreover, for the compliance with safety prescriptions imposing that the user must not receive electric shocks in case he/she touches any part of the appliance that can be at the reach of the user body, in many laundry drying appliance designs the drum (typically made of metal and thus electrically conductive in itself) is kept to the earth potential. This complicates the design of the laundry mass humidity measurement electronic circuit, since a perfect electrical insulation between the AC (Alternate Current) main and the laundry mass resistivity measurement signal must be ensured.

The Applicant has found that measuring the laundry mass humidity by means of capacitive sensing methods is better, being in particular more reliable. One advantage of capacitive sensing over resistivity sensing relies in the fact that while in the latter constant current (Direct Current or DC) electrical signals are used, in the former higher frequency electrical signals are exploited, which are able to more deeply penetrate through the laundry items.

However, the capacitive sensing solution disclosed in EP 1413664 has at least the drawback of necessitating the arrangement of two plates of a condenser around the linen. This may not be easy to implement in already existing designs of laundry machines.

In view of the above, the Applicant has tackled the problem of devising a new solution for sensing the laundry mass drying degree based on capacitive sensing.

According to an aspect thereof, the present invention provides a method for measuring the humidity of a laundry mass contained in a laundry treatment chamber of a laundry appliance (laundry dryer or laundry washer and dryer, i.e., a laundry washing machine also having a laundry drying function) based on a capacitive laundry mass drying degree sensing.

The method comprises: providing a capacitor in the laundry appliance, said capacitor having, as part of the capacitor dielectric, the laundry mass, and measuring a capacitance of said capacitor by means of an electronic circuitry electrically supplied by a supply voltage (Vcc) and a reference voltage (Vref). Said providing a capacitor comprises: providing in the laundry appliance at least one conductive plate which forms a plate of said capacitor, and exploiting, as a second plate of said capacitor, routing lines distributing inside the laundry drying appliance said reference voltage (Vref).

In an embodiment, said measuring a capacitance of said capacitor by means of an electronic circuitry may for example comprise:

coupling said capacitor to a feedback loop of a sigma-delta modulator comprising a reference capacitor;

switching the capacitor between a voltage source and a first node of the reference capacitor to provide a charge current to the reference capacitor using a plurality of switches, wherein a first of the plurality of switches is coupled between the voltage source and a first node of said capacitor and the second of the plurality of switches is coupled between the first node of the capacitor and the first node of the reference capacitor; and converting the capacitance measured on the sensor element to a digital code proportional to the measured capacitance.

In an embodiment, said measuring a capacitance of said capacitor by means of an electronic circuitry may further comprise alternately coupling the capacitor and a discharge circuit to the first node of the reference capacitor, the discharge circuit, when coupled to the first node of the reference capacitor, causing a discharge of the reference capacitor.

In an embodiment, said measuring a capacitance of said capacitor by means of an electronic circuitry may further comprise coupling the discharge circuit to the first node of the reference capacitor for discharging the reference capacitor when the voltage on the reference capacitor reaches a threshold reference voltage.

The method of the present invention is particularly useful for controlling the progress of the laundry drying process.

For example, the method may comprise controlling a laundry mass drying operation of the laundry appliance based on the result of said measuring the capacitance of said capacitor.

In particular, said controlling a laundry mass drying operation may comprise determining one or more drying process control parameters, wherein said drying process control parameters may include one or more of the following:

- a power to be supplied to a drying air heating device for heating drying air which is caused to pass through the laundry treatment chamber;
- a drum rotational speed and/or a drum clockwise/counterclockwise rotation duty ratio;
- a drying process time duration;
- a rotational speed of a drying air fan for propelling the drying air.

In an embodiment, said controlling a laundry mass drying operation of the laundry appliance may comprise determining control parameters that will be used during the following drying process for drying the laundry mass before starting the drying process.

In particular, in embodiments thereof, the method may comprise:

- estimating an amount of water contained in the laundry mass based on the result of said measuring the capacitance of said capacitor;
- estimating a total weight of the wet laundry mass contained in the laundry treatment chamber by means of a weight sensor associated thereto;
- estimating an amount of the laundry to be dried, and
- determining said control parameters based on said estimation of the amount of the laundry to be dried.

More in general, one or more of the following drying process control parameters may be determined based on a measure of capacitance of a capacitor arranged around the laundry to be dried:

- a power to be supplied to a drying air heating device for heating drying air which is caused to pass through the laundry treatment chamber;
- a drum rotational speed and/or a drum clockwise/counterclockwise rotation duty ratio
- a drying process time duration;
- a rotational speed of a drying air fan for propelling the drying air Similarly, the following laundry status parameters may be determined based on a measure of capacitance of a capacitor arranged around the laundry to be dried:

laundry weight;

laundry type;

amount of water contained within the laundry to be dried:

In particular, the above mentioned determinations of drying process control parameters and/or laundry status parameters can be preferably carried out through the method of the present invention which provides an improved accuracy.

According to another aspect thereof, the present invention provides a laundry appliance (laundry dryer or laundry washer and dryer, i.e., a laundry washing machine also having a laundry drying function) with capacitive laundry mass drying degree sensing function, particularly useful for controlling the progress of the laundry drying process.

The laundry appliance, comprising a laundry treatment chamber, comprises an arrangement for measuring the humidity of a laundry mass contained in the laundry drying chamber. Said arrangement comprises a capacitor having, as part of the capacitor dielectric, the laundry mass, and a capacitance sensing arrangement for measuring a capacitance of said capacitor. Said capacitance sensing arrangement comprises an electronic circuitry electrically supplied by a supply voltage (Vcc) and a reference voltage (Vref), and said capacitor comprises at least one conductive plate which forms a plate of said capacitor, and a second plate being formed by routing lines distributing inside the laundry drying appliance said reference voltage (Vref).

In embodiments thereof, the laundry appliance may comprise a control unit configured to control a drying operation of the laundry appliance responsive to said arrangement for measuring the humidity of a laundry mass contained in the laundry drying chamber.

Said control unit may for example be configured to determine one or more drying process control parameters, said drying process control parameters including one or more of the following:

a power to be supplied to a drying air heating device;

a drum rotational speed and/or a drum clockwise/counterclockwise rotation duty ratio;

a drying process time duration;

drying air fan rotational speed.

Said control unit, configured to control a drying operation of the laundry drying appliance, may for example determine control parameters that will be used during the following drying process for drying laundry before starting a drying process.

Said control unit may for example be configured to:

estimate an amount of water contained in the laundry mass based on the result of said measuring the capacitance of said capacitor;

estimate a total weight of the wet laundry mass contained in the laundry treatment chamber by means of a weight sensor associated thereto;

estimate an amount of the laundry to be dried, and determine said control parameters based on said estimation of the amount of the laundry to be dried.

DETAILED DESCRIPTION OF EXEMPLARY NONLIMITING EMBODIMENTS

Figure 1:
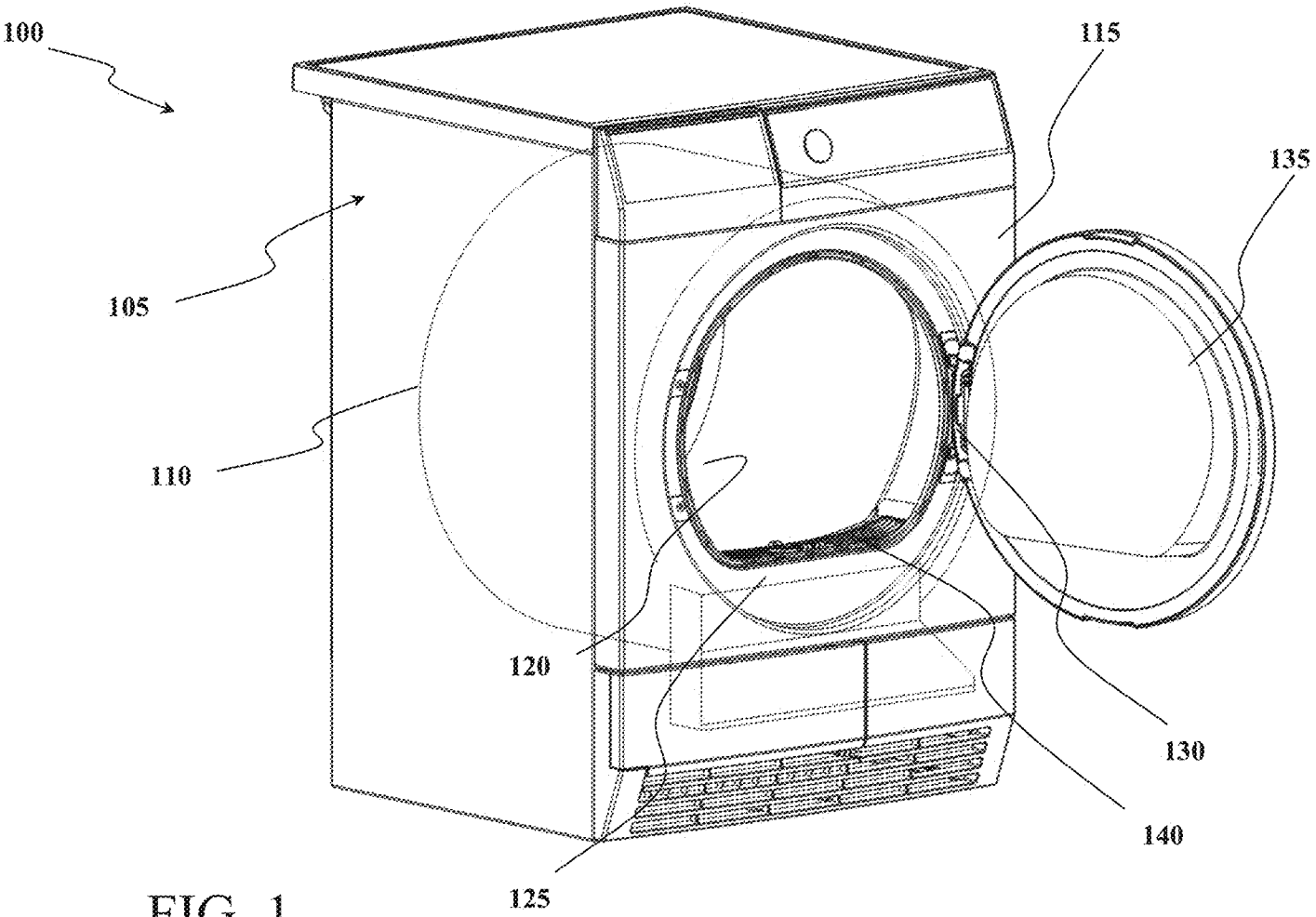
FIG. 1 shows in a perspective view a laundry appliance according to an embodiment of the present invention.

With reference to the drawings, in FIG. 1 there is shown in a perspective view a laundry appliance 100 according to an embodiment of the present invention, for example, although not limitatively, a laundry dryer, particularly a tumble drier. It is pointed out that although here and in the following description reference is made to a laundry dryer, this is not to be construed as a limitation, because the present invention also covers and applies to combined laundry washers and dryers (i.e., laundry washing machines also having a laundry drying function).

The laundry dryer 100 comprises a cabinet 105, for example parallepiped-shaped. The cabinet 105 accommodates therein a laundry treatment chamber (laundry drying chamber in the example here considered of a laundry dryer) for the laundry mass to be dried. The laundry drying chamber is for example defined by the inner space of a rotatable drum 110 which is adapted to contain the laundry mass to be dried (in a combined laundry washer and dryer appliance, the laundry treatment chamber comprises a washing basket or drum which is contained in a washing tub). The cabinet 105 also encloses the electrical, electronic, mechanical, and hydraulic components necessary for the operation of the laundry dryer 100. A front panel 115 of the cabinet 105 has a loading opening 120 providing an access to the rotatable drum 110 for loading/unloading the laundry mass to be dried. The loading opening 120 has a rim 125, preferably substantially annular, in which door hinges 130 as well as door locking means (not shown) are arranged for, respectively, hinging and locking a door 135. The door 135 is adapted for sealably closing the loading opening 120 during the appliance operation.

The laundry dryer 100 comprises a drying air circulation system, for causing drying air to circulate through the drum 110 where the laundry to be dried is loaded. The drying air circulation system is not shown in the drawings, not being of relevance for the understanding of the present invention. Any known drying air circulation system can be adopted, for example an open-loop drying air circulation system (in which drying air is: taken in from the outside ambient, heated up, caused to flow through the drum 110 to extract moisture from the laundry to be dried, then possibly de-moisturized and cooled down and finally exhausted to the outside ambient) or a closed-loop drying air circulation system (in which the drying air is: heated up, caused to flow through the drum 110 to extract moisture from the laundry to be dried, de-moisturized and cooled down, and then again heated up and reintroduced in the drum). The drying air de-moisturizing and cooling system or moisture condensing system can comprise an air-air heat exchanger or a heat pump exploiting a suitable refrigerant fluid. The drying air heater can comprise a Joule-effect heater; in case of use of a heat pump, one of the heat exchangers of the heat pump is used to cool down the moisture-laden drying air, while another heat exchanger of the heat pump can advantageously be exploited for heating the drying air.

The drying air circulation system can for example be designed such that the drying air is introduced into the drum 110 at or proximate to the rear portion thereof (rear with respect to the machine front, corresponding to the front panel 115). After flowing through the drum 110 (and hitting the laundry mass contained therein), the drying air can leave the drum 110 passing through an opening 140 provided close to the rim 125 of the loading opening 120, on the inner side thereof (i.e., looking the machine frontally, behind the rim 125 of the loading opening 120).

The laundry dryer 100 according to the present invention is equipped with a laundry mass drying degree sensing function, advantageously exploited for controlling the progress of the laundry drying process. The laundry mass drying degree sensing function comprises a system for measuring the humidity degree of the laundry mass to be dried.

Figure 2B:
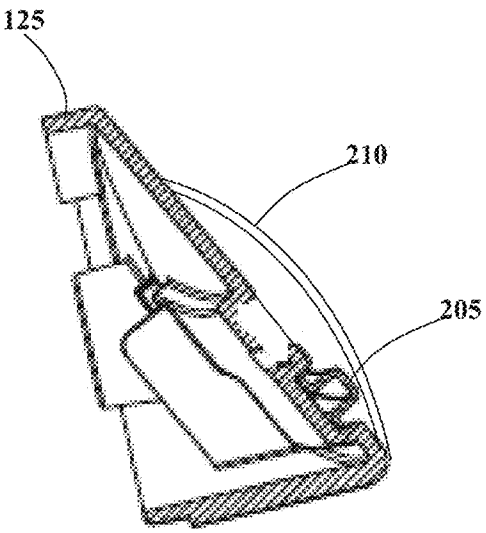
FIGS. 2A and 2B show details of the laundry appliance of FIG. 1, illustrating an exemplary arrangement of a plate of a condenser having the laundry mass to be dried as (part of) the condenser dielectric.
Figure 2A:
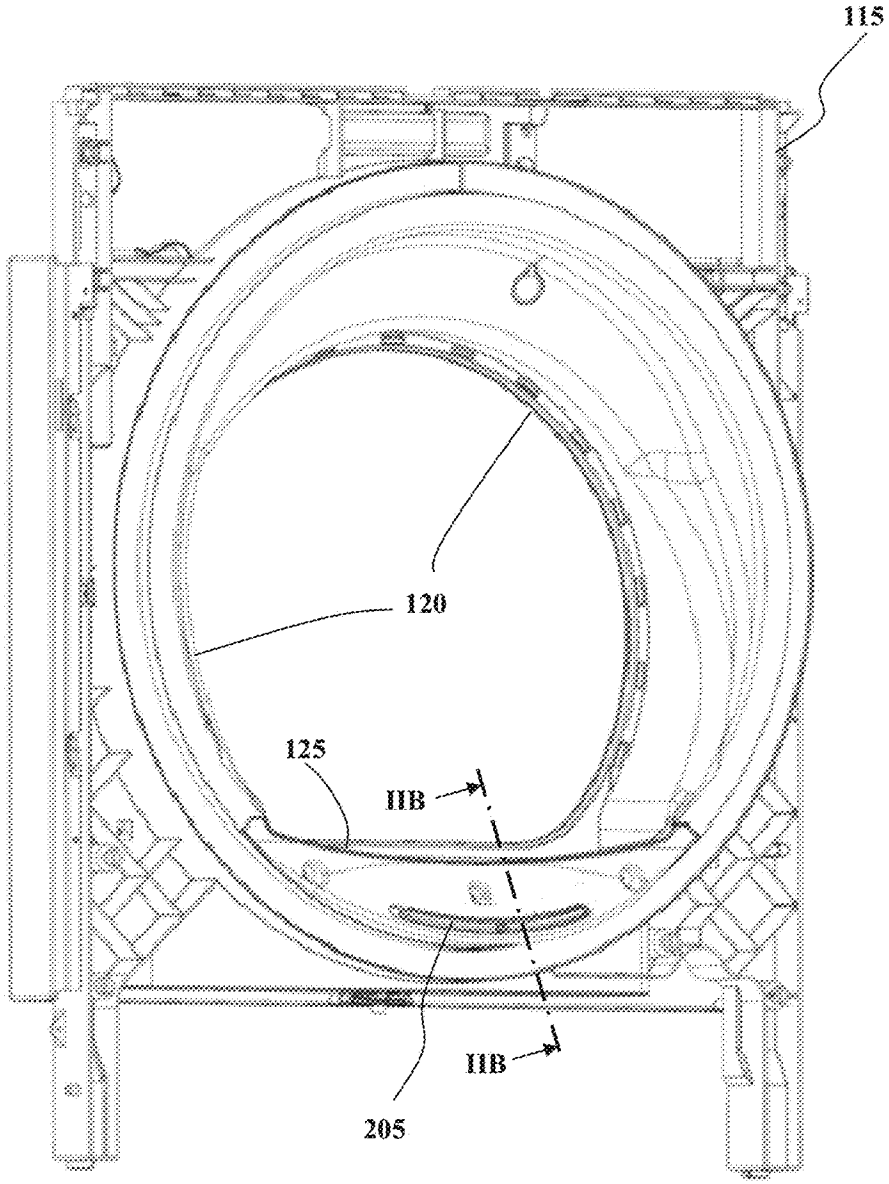

FIG. 2A is a view of the front panel 115 from behind, showing the inner side of the loading opening rim 125, facing towards the drum 110 (in FIG. 2A, the front panel 115 is shown dismounted from the rest of the cabinet 110). FIG. 2B is a partial cross-sectional view along lines IIB-IIB indicated in FIG. 2A. There is shown a conductive plate member, e.g. a metal plate 205 (being part of the system for measuring the humidity degree of the laundry mass to be dried), that is mounted to the inner side of the cabinet front panel 115, in the shown example just below the rim 125 of the loading opening 120, so as to face the drum 110 and, in operation, being in front of the laundry mass to be dried that, while it tumbles inside the rotatable drum 110, falls by gravity to the bottom of the drum 110. Preferably, the conductive plate 205 is arranged so as to not be directly touched by the laundry, being to this purpose protected, covered by a dielectric cover 210, e.g. made of plastic.

Figure 3:
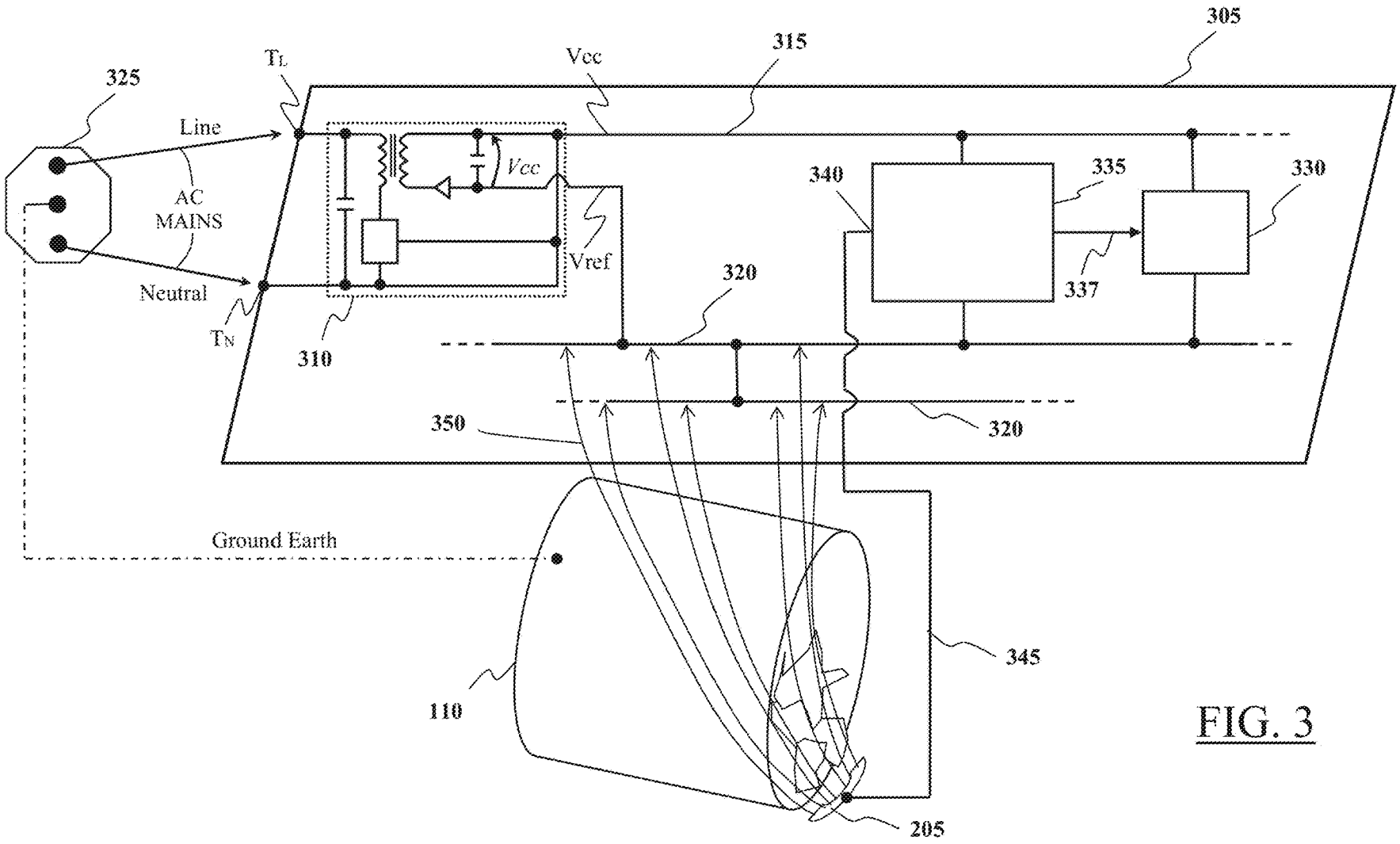
FIG. 3 schematically shows, partly in terms of functional blocks, the construction of a system for measuring the humidity degree of the laundry mass to be dried according to an embodiment of the present invention.

The pictorial schematic of FIG. 3 is useful to understand the construction of the system for measuring the humidity degree of the laundry mass to be dried according to an embodiment of the present invention.

Reference numeral 305 denotes a Printed Circuit Board (PCB), or plurality (system) of PCBs, of the appliance 100 electronics, shown schematically and with only a few of the (several other) electronic/electromechanical components actually present in the laundry dryer 100.

A DC (Direct Current) power supply generation circuit 310 generates the DC electric potentials for supplying the electronics. In particular, for what is relevant here, the DC power supply generation circuit 310 generates two DC electric potentials Vcc and Vref, where the value of the electric potential Vcc, being the supply voltage for the electronics, is equal to the value of the electric potential Vref, being the reference voltage for the electronics, plus a nominally constant value Vcc which is typically 5 V, or 3.3 V, or less, depending on the families of Integrated Circuits to be power supplied. The two DC electric potentials Vcc and Vref are distributed, i.e. routed, through the PCB (or plurality of PCBs) 305 by means of a system of conductive tracks, comprising conductive tracks 315 for routing the electric potential (supply voltage) Vcc, and conductive tracks 320 for routing the electric potential (reference voltage) Vref, so as to be brought to the locations, on the PCB/PCBs 305, where electronic components are placed. In alternative embodiments, the conductive tracks 315 and/or the conductive tracks 320 may be replaced by conductive wires.

The DC power supply generation circuit 310 generates the two DC electric potentials Vcc and Vref starting from an AC voltage (e.g., 230 V@50 Hz, or 110 V@60 Hz) supplied by an AC power distribution network to the premises of the users. Electric terminals $T_L$ and $T_N$ on the PCB 305 receive a line AC voltage Line and a neutral AC voltage Neutral when the appliance is plugged to an AC main socket 325. The DC power supply generation circuit 310 comprises transformers, condensers, rectifiers, and DC voltage regulators. The AC main socket 325 (and the appliance plug) also has a ground earth contact providing a ground earth potential. In order to comply with safety prescriptions imposing that the user must not receive electric shocks in case he/she touches any part of the appliance that can be at the reach of the user body, such appliance parts are kept to the ground earth potential. It is pointed out that the electric potential (reference voltage) Vref for the electronics is typically not equal to the ground earth potential. In some embodiments, the machine could even have no connection to the ground earth potential (Class II machines), this not affecting the implementation of the solution according to the present invention.

In particular, the DC electric potentials Vcc (supply voltage) and Vref (reference voltage) are routed and supply DC power to an appliance control unit, schematized as a functional block 330, that governs the appliance operation, in response to command inputs imparted by an appliance user through a user command interface (e.g. comprising drying program selector means).

The DC electric potentials Vcc and Vref are also routed and supply DC power to a capacitance sensing circuit arrangement 335 configured for sensing (changes in) capacitance consequent to changes in the degree of humidity of the laundry mass contained in the drum 110 while being dried. The capacitance sensing circuit arrangement 335 feeds the results 337 of its readings to the appliance control unit 330, which advantageously exploits the capacitance change readings provided thereto by the capacitance sensing circuit arrangement 335 to derive information about the degree of humidity of the laundry mass being dried and, possibly, adapting the on-going drying program on the go, based on the detected conditions of humidity of the laundry mass.

Figure 6:
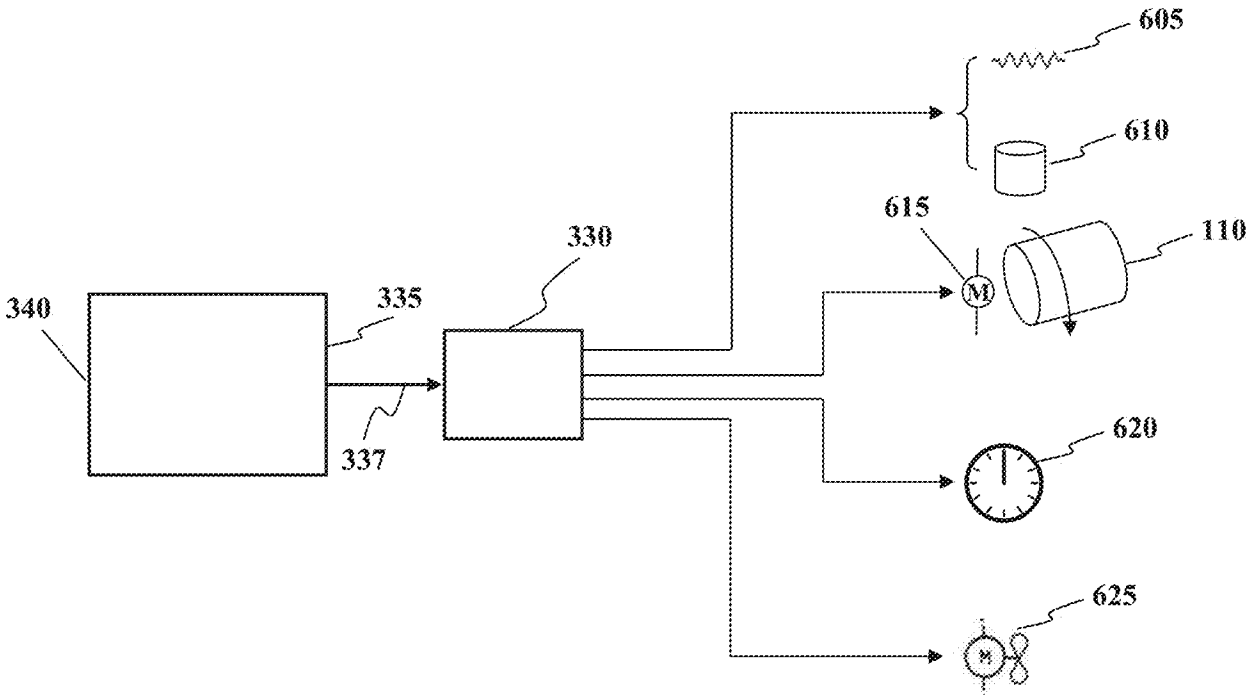

The information about the degree of humidity of the laundry mass derived by the control unit 330 from readings of the capacitance sensing circuit arrangement 335 can be used also before starting a drying phase of a drying process to estimate the amount of water contained in the laundry mass to be dried, i.e. before removing water from laundry. Such information can be used by the control unit 330 to determine control parameters that will be used during the following drying process for drying laundry. In particular, as schematized in FIG. 6, the initial estimation of water amount contained in the laundry mass can for example be used for determining one or more drying process control parameters such as:

- power to be supplied to a drying air heating device (a Joule-effect heater 605 or a refrigerant condenser in a heat pump system, in the latter case the power supplied to the condenser depends on the target power and/or speed provided to a heat pump compressor 610);

drum 110 rotational speed and/or drum clockwise/counterclockwise rotation duty ratio, achieved by controlling a drum 110 drive motor 615;

drying process time duration (schematized by 620 in the drawing);

drying air fan 625 rotational speed;

One or more of said control parameters may be even adjusted and/or modified with respect to an initial parameter setting, which is for example pre-defined for each dying program selectable by a user through a program selector available in the laundry appliance.

The initial estimation of water amount contained in the laundry mass can be associated to a further estimation of the laundry amount only, e.g. derived from a weight sensor operatively associated with the drum 110. On the one side, the weight sensor provides an estimation of the amount of laundry contained in the drum. On the other side, the control unit 330 derives, from the readings of the capacitance sensing circuit arrangement 335, an estimation of the amount of water contained in the laundry mass. Indeed, the weight estimation obtained by the weight sensor is an estimation of the total weight (laundry mass plus water), whereas from the readings of the capacitance sensing circuit arrangement 335 an estimation of the amount of water alone is obtained. By subtracting the estimation of the amount of water from the estimation of the total weight, the control unit 330 can derive an indication of the amount of laundry alone. Based on this estimation, the control unit can adjust the drying process control parameters to better adapt the drying process to the actual amount of laundry to be dried.

The adjusted control parameters can be either applied directly to the drying process, in a way transparent to the user, or the user may be presented a suggestion to change the previously selected drying process.

The capacitive laundry mass drying degree sensing function could also be provided in combination with a conventional laundry mass resistivity sensing function, in order to enhance the accuracy of the laundry humidity degree measure (in particular, the laundry mass resistivity sensing function may support the capacitive laundry mass drying degree sensing function, or vice-versa, for achieving a reliable humidity degree measure). In particular, one (or more) capacitive sensing arrangement, possibly in combination with a weight sensor and/or a laundry mass resistivity sensing arrangement, can provide information useful for estimating a time necessary to terminate a drying cycle selected by the user (based on known operating parameters of the machine related to the selected cycle, such as the process air temperature, the drum rotational speed, the drying air fan rotational speed, the operating course of the drying air heating means).

The capacitance sensing circuit arrangement 335 has an input 340 which is electrically coupled, as indicated by line 345, with the conductive plate 205.

Figure 4:
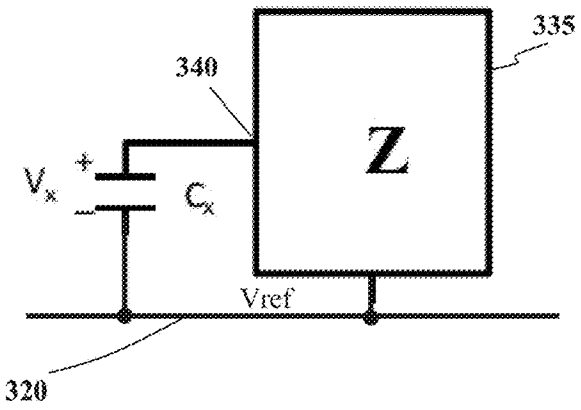
FIG. 4 schematizes a self-capacitance sensing method adopted in the system for measuring the humidity degree of the laundry mass to be dried according to an embodiment of the present invention.

In particular, according to an embodiment of the present invention, the capacitance sensing circuit arrangement 335 is configured to implement a self-capacitance sensing method, schematized in FIG. 4. Essentially, in the self-capacitance sensing method the capacitance between a single circuit node and a reference electric potential is measured. In the case considered here, the single circuit node (electrode plate) corresponds to the input 340 of the capacitance sensing circuit arrangement 335, and the reference electric potential is the DC reference voltage Vref. The capacitance sensing circuit arrangement 335 drives a current on the input 340 and measures the voltage Vx (referred to the DC reference voltage Vref) that develops across the unknown capacitance Cx whose value is to be determined.

In FIG. 3, thin curves 350 schematize the electric field lines that start at the metal plate 205 and end at the conductive tracks 320 that, in the PCB (or plurality of PCBs) 305, route the reference electric potential Vref. It is pointed out that the electric field lines do not end at the drum 110, because the drum 110 is not at the DC reference voltage Vref, being instead at a different electric potential. In particular, the actual electric potential of the drum 110 may depend on the circumstances, and it is not necessarily the ground earth potential. For example, let it be supposed that the drum 110 is driven by a belt (which, due to the material of which it is made, has a certain electric impedance). The belt, through pulleys, is driven by an electric motor, which, for safety prescriptions, is kept to the ground earth. Thus, in this example the drum 110 may be connected to the ground earth, but (due to the impedance of the belt) is at a potential different from the ground earth. At the same time, the drum 110 is not at the DC reference voltage Vref, which, as pointed out in the foregoing, is typically not the ground earth.

Figure 5:
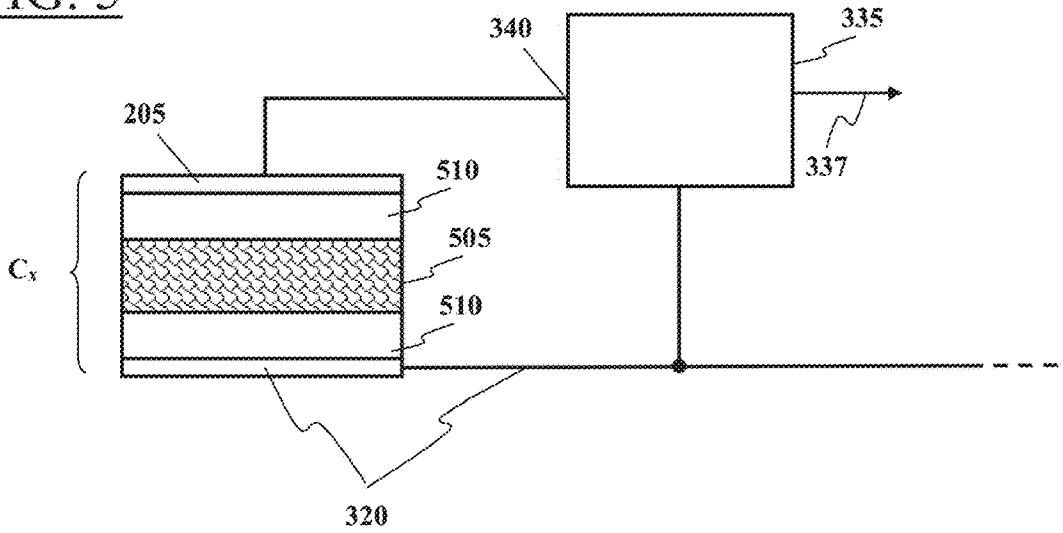
FIG. 5 shows an electric scheme of the system according to an embodiment of the present invention, and FIG. 6 schematizes some of the possible controls of a laundry drying process that can be operated based on the laundry mass humidity degree measuring method.

FIG. 5 schematizes the system according to an embodiment of the present invention. $C_x$ denotes the capacitor whose unknown capacitance Cx is to be determined. The capacitor $C_x$ has a dielectric that is formed by: the dielectric cover 210 separating the conductive plate 205 from the laundry mass 505 to be dried housed in the drum 110, the laundry mass 505 itself, plus air 510. The capacitor $C_x$ has a plate formed by the metal plate 205, the other plate of capacitor $C_x$ is virtual, being constituted by the reference electric potential (reference voltage) Vref that is routed by conductive tracks 320 in the PCB 305.

Since the permittivity of the laundry mass housed in the drum 110 varies considerably according to the laundry mass humidity, the capacitance Cx of capacitor $C_x$ varies according to the laundry mass humidity degree. By sensing the capacitance Cx of the capacitor $C_x$, an indication of the laundry mass humidity degree can be derived.

Methods for measuring capacitances are known in the art.

Some known methods for measuring capacitances make use of a switched capacitor network comprising the capacitor $C_x$ whose unknown capacitance Cx is to be determined, a reference capacitor of known capacitance (larger than the unknown capacitance to be determined), and an arrangement of switches.

One known capacitance measuring method using a switched capacitor network is the "charge transfer" method: the capacitor $C_x$ whose unknown capacitance Cx is to be determined is repeatedly charged to the voltage of a voltage source, and its charge is transferred to the reference capacitor. By counting the number of times the capacitor $C_x$ whose capacitance Cx is to be determined needs to be charged and its charge transferred to the reference capacitor until the latter is charged up to a threshold (voltage) value (or by measuring the time needed to charge the reference capacitor up to the threshold voltage value), it is possible to derive the value of the unknown capacitance. Preferably, countermeasures are taken for increasing the immunity against noise, like for example averaging.

Another known measuring method using a switched capacitor network is the "sigma-delta modulation" method. Differently from the charge transfer method, the reference capacitor is not charged from an initial voltage to a threshold (reference) voltage, rather, the voltage across the reference capacitor is modulated about the reference voltage in charge up and charge down steps. The capacitor $C_x$ whose unknown capacitance Cx is to be determined, coupled to a feedback loop of a sigma delta modulator, is switched between a voltage source and a reference capacitor (by means of a first switch, coupled between the voltage source and a first node of the capacitor $C_x$, and a second switch, coupled between the first node of the capacitor $C_x$ and the first node of the reference capacitor), and charge is transferred from the capacitor $C_x$ to the reference capacitor. As the charge in the reference capacitor increases by charge transfer from the capacitor $C_x$, so does the voltage across it. The voltage across the reference capacitor is fed to one input of a comparator, whose other input is kept at the threshold voltage. When the input of the comparator reaches the threshold voltage, a discharge circuit (e.g., a resistor in series to a switch) in shunt to the reference capacitor is activated and the reference capacitor is discharged at a rate determined by the starting voltage across the reference capacitor and the resistance of the discharge circuit. As the voltage across the external capacitor decreases, it again passes the threshold voltage and the discharge circuit is deactivated. The charge/discharge cycle is then repeated: charge is again transferred from the capacitor $C_x$ to the reference capacitor, to increase again the voltage across the reference capacitor, and so on. The charge/discharge cycle of the reference capacitor produces a bit stream at the comparator output. Such bit stream is put in logical 'AND' with a pulse-width modulator to enable a timer. The timer output is used for processing the extent of the change of the capacitance Cx.

Another known capacitance measuring methods is the "RC method": in this case, the unknown capacitance to be determined is derived from the time needed to charge or discharge the capacitor whose capacitance is to be determined through a resistor of known resistance.

A further known method for measuring a capacitance is the "Wheatstone bridge method": in this method, a Wheatstone bridge is balanced in order to bring unbalance currents to zero.

The present invention has been here described in detail making reference to some possible embodiments thereof. Other embodiments are possible and at the reach of the person skilled in the art.

The invention claimed is:

1. A method for operating a laundry appliance having a laundry treatment chamber and a capacitor comprising at least one conductive plate which forms a first plate of the capacitor, a supply line configured to carry a supply voltage to a controller of the laundry appliance, routing lines configured to carry a reference voltage to the controller of the laundry appliance, the routing lines configured as a second plate of the capacitor, the controller connected to a supply voltage via a supply line and connected to the reference voltage via at least one of the routing lines, and a dielectric including a content of the laundry treatment chamber separating the first plate from the second plate, the method comprising:

generating the reference voltage on the routing lines and generating the supply voltage on the supply line;

measuring, by the controller, a capacitance between the at least one conductive plate and the routing lines of the capacitor; and estimating, by the controller, a humidity of the content of the laundry treatment chamber based on the measured capacitance of the capacitor.

2. The method of claim 1, wherein measuring a capacitance of the capacitor comprises:

coupling the capacitor to a feedback loop of a sigma-delta modulator comprising a reference capacitor;

switching the capacitor between a voltage source and a first node of the reference capacitor to provide a charge current to the reference capacitor using a plurality of switches, wherein a first of the plurality of switches is coupled between the voltage source and a first node of the capacitor and a second of the plurality of switches is coupled between the first node of the capacitor and the first node of the reference capacitor; and converting the capacitance measured on a sensor element to a digital code proportional to the measured capacitance.

3. The method of claim 2, further comprising:

alternately coupling the capacitor and a discharge circuit to the first node of the reference capacitor; and, when the discharge circuit is coupled to the first node of the reference capacitor, discharging the reference capacitor.

4. The method of claim 3, further comprising:

coupling the discharge circuit to the first node of the reference capacitor and discharging the reference capacitor when the voltage on the reference capacitor reaches a threshold reference voltage.

5. The method of claim 1, wherein the content of the laundry treatment chamber comprises a laundry mass, and the method further comprising controlling a laundry mass drying operation of the laundry appliance based on the estimated humidity of the laundry mass.

6. The method of claim 5, wherein controlling the laundry mass drying operation comprises one or more of:

controlling a power supplied to a drying air heating device for heating drying air which is caused to pass through the laundry treatment chamber;

controlling a drum rotational speed;

controlling a drum clockwise/counterclockwise rotation duty ratio;

controlling a drying process time duration; and controlling a rotational speed of a drying air fan for propelling drying air.

7. The method of claim 5, wherein controlling the laundry mass drying operation comprises:

determining control parameters; and starting a drying process using the control parameters.

8. A laundry appliance comprising:

a laundry treatment chamber;

a controller connected to a supply line configured to carry a supply voltage to a controller and connected to at least one routing line of a plurality of routing lines configured to carry a reference voltage to the controller; and a capacitor having:

a first plate comprising at least one conductive plate located inside the laundry appliance;

a second plate comprising the routing lines located inside the laundry appliance; and a dielectric located between the first plate and the second plate and comprising a content of the laundry treatment chamber; and wherein the controller is configured to determine a capacitance between the at least one conductive plate and the routing lines of the capacitor, and estimate a humidity of the contents of the laundry treatment chamber based on the capacitance of the capacitor.

9. The laundry appliance of claim 8, wherein the controller is configured to control a drying operation of the laundry appliance responsive to the estimated humidity.

10. The laundry appliance of claim 9, wherein the controller is configured to determine one or more drying process control parameters, the drying process control parameters including one or more of:

a power to be supplied to a drying air heating device;

a drum rotational speed and/or a drum clockwise/counterclockwise rotation duty ratio;

a drying process time duration; and drying air fan rotational speed.

11. The laundry appliance of claim 8, wherein the content of the laundry treatment chamber comprises a laundry mass, and the controller is configured to control a drying operation of the laundry drying appliance based on an estimated humidity of the laundry mass.

* * * * *